US010208636B2

(12) United States Patent
Kohler et al.

(10) Patent No.: US 10,208,636 B2
(45) Date of Patent: Feb. 19, 2019

(54) HIGHLY THERMALLY CONDUCTIVE VALVE SEAT RING

(71) Applicant: Bleistahl-Produktions GmbH & Co. KG, Wetter/Ruhr (DE)

(72) Inventors: Ekkehard Kohler, Wetter (DE); Dirk Emde, Ennepetal (DE); Anna Seyfarth, Dortmund (DE); Thomas Lelgermann, Oberhausen (DE)

(73) Assignee: Bleistahl-Produktions GmbH & Co, KG, Wetter (DE)

( * ) Notice: Subject to any disclaimer, the term of this patent is extended or adjusted under 35 U.S.C. 154(b) by 0 days.

(21) Appl. No.: 15/629,373

(22) Filed: Jun. 21, 2017

(65) Prior Publication Data

US 2017/0298790 A1 Oct. 19, 2017

Related U.S. Application Data

(62) Division of application No. 14/410,955, filed as application No. PCT/EP2013/064000 on Jul. 3, 2013, now Pat. No. 9,702,277.

(30) Foreign Application Priority Data

Jul. 4, 2012 (DE) ..... 10 2012 013 226

(51) Int. Cl.

| | |
|---|---|
| ***F01L 3/22*** | (2006.01) |
| ***F01L 3/08*** | (2006.01) |
| ***B22F 3/16*** | (2006.01) |
| ***B22F 1/00*** | (2006.01) |
| ***C22C 38/16*** | (2006.01) |

(Continued)

(52) U.S. Cl.

CPC ..... *F01L 3/08* (2013.01); *B22F 1/0003* (2013.01); *B22F 3/16* (2013.01); *B22F 7/008* (2013.01); *B22F 7/02* (2013.01); *C22C 38/04* (2013.01); *C22C 38/16* (2013.01); *C22C 38/42* (2013.01); *C22C 38/44* (2013.01); *C22C 38/46* (2013.01); *C22C 38/52* (2013.01); *C22C 38/60* (2013.01); *F01L 3/02* (2013.01); *F05C 2201/046* (2013.01); *F05C 2251/04* (2013.01)

(58) Field of Classification Search

CPC ..... F01L 3/02; F01L 3/04; F01L 3/08

See application file for complete search history.

(56) References Cited

U.S. PATENT DOCUMENTS 4,332,616 A 6/1982 Morishita et al.

FOREIGN PATENT DOCUMENTS

| | | |
|---|---|---|
| EP | 0372223 A1 | 6/1990 |
| EP | 1002883 A1 | 5/2000 |

(Continued)

OTHER PUBLICATIONS

Written Opinion issued in connection with related PCT Application No. PCT/EP2013/064000.

*Primary Examiner* — Gilbert Y Lee

(74) *Attorney, Agent, or Firm* — Brooks Kushman P.C.

(57) ABSTRACT

The invention relates to a powdermetallurgically produced valve seat ring having a carrier layer and a function layer. It is the objective of the invention to provide a valve seat ring of the kind mentioned above that offers significantly higher thermal conductivity properties. To achieve this objective and based on a valve seat ring of the kind first mentioned above the invention proposes that the carrier material of the carrier layer has a thermal conductivity higher than 55 W/m*K at a total copper content ranging between >25 and 40% w/w.

16 Claims, 3 Drawing Sheets

(51) Int. Cl.

| | |
|---|---|
| ***C22C 38/04*** | (2006.01) |
| ***C22C 38/60*** | (2006.01) |
| ***C22C 38/52*** | (2006.01) |
| ***C22C 38/44*** | (2006.01) |
| ***C22C 38/46*** | (2006.01) |
| ***C22C 38/42*** | (2006.01) |
| ***B22F 7/00*** | (2006.01) |
| ***B22F 7/02*** | (2006.01) |
| ***F01L 3/02*** | (2006.01) |

(56) References Cited

FOREIGN PATENT DOCUMENTS

| | | | |
|---|---|---|---|
| EP | 1375841 | A2 | 1/2004 |
| GB | 2117413 | A | 10/1983 |
| JP | 57-39104 | | 3/1982 |
| JP | 56-121810 | | 9/1982 |
| JP | 11-302805 | | 11/1999 |
| JP | 2005048263 | A | 2/2005 |

HIGHLY THERMALLY CONDUCTIVE VALVE SEAT RING

The invention relates to a valve seat ring that is produced by powder metallurgical technique and comprises a carrier material as well as a function material.

Valve seat rings of the kind first mentioned above are, for example, known from the Japanese laid-open patent application JP 6145720 A. This publication describes a copper-infiltrated multilayer valve seat ring with Co- and Mo-constituents for internal combustion engines.

In principle, the prior-art valve seat rings have an advantage in that they exhibit excellent strength. This is particularly due to the fact that two different material layers are provided, with the carrier material in that case offering outstanding strength characteristics. Such prior-art valve seat rings of the kind mentioned above have a disadvantage, however, in that they can no longer meet the increasing demands of internal combustion engines since their thermal conductivity properties are poor. The thermal conductivity of conventional carrier materials is less than 45 W/m*K as a rule.

It is the objective of the present invention to provide a valve seat ring of the kind mentioned above that offers significantly higher thermal conductivity properties. Moreover, the valve seat ring shall satisfy customary requirements with respect to tightness, dimensional accuracy, and strength.

To achieve this objective and based on a valve seat ring of the kind first mentioned above the invention proposes that the carrier material of the carrier layer (2) has a thermal conductivity higher than 55 W/m*K at a total copper content ranging between >25 and 40% w/w. The total copper content of the inventive valve seat rings is preferably composed of an iron-copper alloy, added copper powder, and infiltrated copper.

All percentages indicated hereunder are in percent by weight.

The valve seat ring in accordance with the invention features high thermal conductivity combined with high strength and lends itself to being used in modern internal combustion engines. This offers the following advantages:

- Faster heat transfer in the cylinder head,
- Lower valve temperature,
- Due to lower valve temperatures the combustion engine's knock tendency is reduced,
- More uniform temperature distribution in the valve seat ring,
- Deformation of the valve seat rings caused by inhomogeneous temperature is distribution is reduced,
- Leaks in the combustion space are reduced due to improved deformation resistance of the valve seat rings.

A preferred embodiment of the valve seat ring provides for the carrier material to have a thermal conductivity of more than 65 W/m*K. This variant is especially suited for use in engines equipped with turbocharging systems. The combustion temperature of a gasoline engine is higher than that of a diesel engine. On the other hand, the ignition temperature of a diesel engine is about 200 to 300° C. higher than that of a gasoline engine. In any case, it is mandatory to eliminate the high temperature as quickly as possible to prevent the engine block from being damaged.

An especially preferred embodiment of the valve seat ring provides for the carrier material to have a thermal conductivity of more than 70 W/m*K. This embodiment is needed for high-duty engines, for example those in sports cars or for motorsports uses where the potential of the engines is exploited to the full. Under such circumstances an increased thermal conductivity will improve the life of the engine.

Preferably, the carrier material comprises an iron-copper alloy. In this combination, the high strength of iron and the good thermal conductivity of copper result in especially positive characteristics of the carrier material for the given application.

The valve seat ring manufactured by powder metallurgical method exhibits particularly good properties if the copper content of the iron-copper alloy exceeds 5% w/w, in particular is at 10% w/w. This alloying configuration enables the advantages of iron and copper to be utilized especially well. The maximum solubility of copper in the austenite is 8.5% w/w at 1094° C. However, the copper may have been integrated into the iron-copper alloy both as alloying addition and by the diffusion bonded method. With diffusion bonded copper percentages significantly exceeding 8.5% w/w can be achieved. Within the scope of the invention the term iron-copper alloy shall also embrace iron with diffusion bonded copper.

A favorable embodiment of the valve seat ring provides for the carrier material to consist of a mixture of an iron-copper alloy and copper powder. In this case, the copper serves to agglutinate the iron constituents thus forming into a cohesive matrix. The increased copper content enables heat to pass through the material particularly well. This ensures a long service life of the involved machine elements in the area of the valve seat rings. An especially good combination of thermal conductivity and strength can be achieved if the percentage of the copper powder ranges between 8 and 12, in particular amounts to 10% w/w. The matrix thus formed by the copper in this case offers especially good thermal conductivity without noteworthily impairing the carrier function of the iron. Due to the ever increasing performance of the engines and in view of the higher operating temperatures thus occurring an increase of the thermal conductivity of valve seat rings also results in favorably influencing and thus improving the service life of said valve seat rings.

For an especially preferred variant of an inventive valve seat ring it is proposed that the carrier material and/or the function material additionally contain copper which is added by means of infiltration. Infiltration serves the purpose of filling the pores of the green compact. This takes place during the sintering process when the liquid copper is drawn into the pores by capillary action. Whereas pores in sintered products usually have a heat insulating effect, the thermal conductivity is significantly increased in comparison with the base material, in this case the carrier and function materials. This means the workpiece volume can be optimally used to optimize thermal conductivity characteristics.

Valve seat rings produced by powder metallurgical techniques with an infiltrated copper contents of approx. 20% w/w are known per se. It has nevertheless been found that the thermal conductivity of the valve seat ring is particularly favorable if the copper content of the carrier material amounts to >25% w/w, especially ranges between 25 and 40% w/w, in which case the strength characteristics of the iron remain unimpaired. While the strength properties of iron are higher than those of copper, the thermal conductivity of copper is better. With the above described alloy composition of the carrier material the advantages offered by both metals can be combined without having to face their detriments. Such a high copper contents of the carrier material can be reached if in addition to copper infiltration an iron-copper alloying powder is used for the carrier material and admixed to the copper powder.

The total copper content of the inventive valve seat rings preferably ranges between >28 and 40% w/w.

An especially advantageous composition of the carrier material is listed in the following table:

| | |
|---|---|
| 0.5 to 1.5% w/w | C |
| 0.1 to 0.5% w/w | Mn |
| 0.1 to 0.5% w/w | S |
| >25 to 40% w/w | Cu (total) |
| Balance | Fe. |

In a preferred embodiment the alloying composition of the function material is as follows:

| | |
|---|---|
| 0.5 to 1.2% w/w | C |
| 6.0 to 12.0% w/w | Co |
| 1.0 to 3.5% w/w | Mo |
| 0.5 to 3.0% w/w | Ni |
| 1.5 to 5.0% w/w | Cr |
| 0.1 to 1.0% w/w | Mn |
| 0.1 to 1.0% w/w | S |
| 8.0 to 22.0% w/w | Cu (infiltrated) |
| Balance % w/w | Fe. |

The function material in this case is of customary type. Since the alloying elements are cost-intensive materials it is attempted to optimize respectively minimize the share of the function layer in the entire valve seat ring. Bearing in mind that valve seat rings are mass products this means an enormous reduction of costs due to the fact that the proportion of expensive materials decreases.

An alternative embodiment of the function layer consists of the following function material:

| | |
|---|---|
| 0.5 to 1.5% w/w | C |
| 5.0 to 12.0% w/w | Mo |
| 1.5 to 4.5% w/w | W |
| 0.2 to 2.0% w/w | V |
| 2.2 to 2.8% w/w | Cr |
| 0.1 to 1.0% w/w | Mn |
| 0.1 to 0.5% w/w | S |
| 12.0 to 24.0% w/w | Cu (infiltrated) |
| Balance % w/w | Fe. |

The choice of materials for the function layer depends on the requirements the valve seat ring must satisfy. If the function material has the required characterise tics, the less expensive variant is to be selected.

Moreover, the invention also relates to a method of manufacturing a valve seat ring by powder metallurgical techniques comprising a carrier layer consisting of a carrier material as well as a function layer of a function material, with the following steps being taken:

Manufacturing a carrier layer using a carrier material consisting of an iron-copper alloy powder, where necessary, press forming the powder of the carrier layer into a semi-finished product, manufacturing a function layer using a customary powdery function material, press forming the powder into a green compact, sintering the green compact in contact with copper.

The function and carrier layers in this case have different properties. Whereas the function layer of the valve seat ring is particularly designed with respect to thermal stresses, the carrier layer features the necessary strength and improved thermal conductivity. Additionally, the carrier material consists of an iron-copper alloy powder.

The carrier layer is composed of an iron-copper alloy powder. Iron imparts strength while copper improves the thermal conductivity characteristics of the carrier layer. The powder of the carrier layer is then press formed into a semi-finished product. With respect to the inner edge of the semi-finished valve seat ring the surface inclination of the ring can be adjusted to suit relevant requirements. In accordance with the teaching of the invention the angle of inclination in relation to the horizontal level ranges between 20° and 40°. It can thus be decided at which points the function layer is designed to be stronger or less strong. As a result of the pre-determinable tapering contour of the carrier layer the proportion and thus the cost of the function layer can be minimized. This semi-finished product is covered with a powdery function material and then press formed into a green compact. Said green compact is brought into contact with copper during the sintering process. The pores of the pressed green compact enable liquid copper to penetrate into the workpiece by capillary action. Through the enrichment of the workpiece with copper in this way the thermal conductivity will be significantly increased whereas the supporting function of the carrier and function layers is maintained.

A preferred embodiment of the method provides for the iron-copper alloy powder is of the carrier layer to be combined with a copper powder, wherein the proportion of the copper powder in the total alloy amounts to more than 15% w/w. Surprisingly, it has been found that by following the procedure described hereinbefore the supporting/carrier characteristics of iron will not be impaired, while the thermal conductivity of copper increases constantly. The copper powder causes the iron-copper particles to become agglutinated, wherein the latter will not have an inacceptable influence on the strength of the material since their contents of up to 15% w/w is relatively low.

An especially preferred embodiment of the method provides for the iron-copper alloy powder to be combined with graphite, with the contents of the graphite in the total alloy amounting to between 0.5 and 1.5% w/w. The lubrifying effect of the graphite prevents seizing of the carrier layer surface and in this way extends the service life of the valve seat ring.

A helpful embodiment of the method proposes that the carrier layer is compressed to form a semi-finished component having a density of between 6.5 and 7.5 g/cm$^3$ by applying a pressing force ranging between 450 and 700 MPa. With respect to the infiltration of copper these parameters have unexpectedly turned out to most favorably influencing the necessary capillary action since the size of the pores is ideal for this purpose. The infiltrating copper is admitted into the workpiece via the pore ducts thus created. Too high a pressure and density prevents the copper from entering the workpiece whereas with too low a pressure and density the necessary valve seat ring strength requirements cannot be complied with. The pressing force to be applied according the teaching of the invention is lower than the customary pressing force which accordingly results in a lower density of the green compacts. Due to the lower density more pores are created which are then filled by copper infiltration. In this way, the copper absorption via infiltration will be higher than could be achieved up to now.

The method allows specific and complex valve seat ring properties to be realized in that the densified green compact is of multi-layer configuration. This offers the following two benefits: On the one hand, a cost-efficient material is used for areas of the valve seat ring where only lower stresses arise. On the other hand, by appropriately varying the alloy composition and layer thickness at various places the properties in each case can be tailored to the given needs.

The sintering process is carried out at a temperature that exceeds the melting temperature of copper. Copper infiltration may take place in this way, wherein the molten copper during the sintering process penetrates into the open pores of the workpiece through capillary action.

For infiltration, the copper may be fed to the green compact as a ring.

Exemplary embodiments of the invention are illustrated by way of the following drawings where FIG. 1 is a sectional representation of the valve seat ring;

Figure 1:
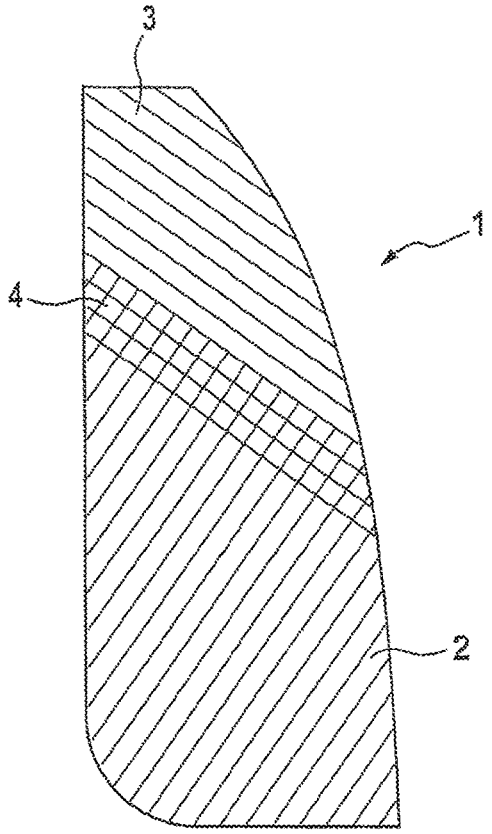

FIG. 1 is a sectional view of a valve seat ring 1. The carrier layer 2 volumetrically forms the biggest part of the valve seat ring 1, with function layer 3 being situated in the upper portion of valve seat ring 1 and essentially serving as supporting face for valves. Clearly visible is the inclination between carrier layer 2 and function layer 3 extending along the valve seat ring as parallelly as possible to the supporting face of the valves. At the point where carrier layer 2 and function layer 3 meet, a diffusion layer 4 forms. Said diffusion layer 4 forms in particular during sintering of the previously densified green compact.

Figure 2:
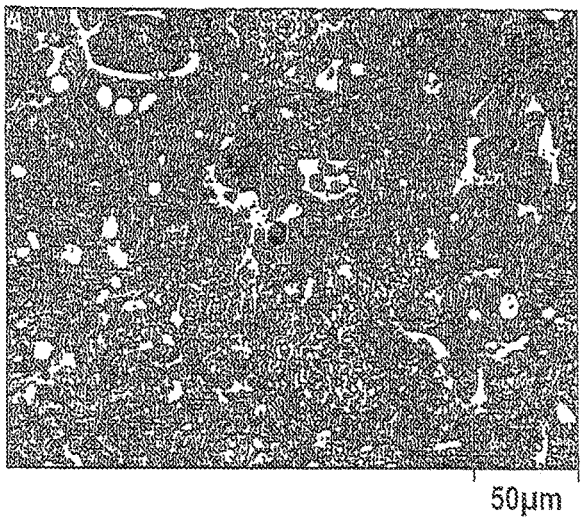
FIG. 2 is a micrograph of the old carrier layer.
Figure 3:
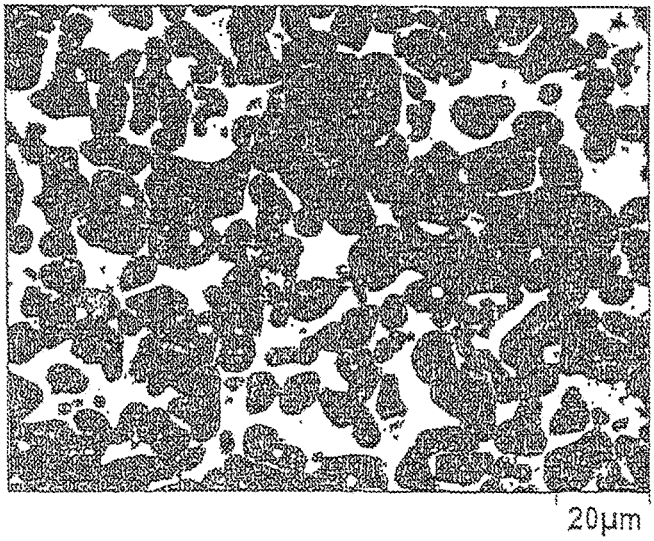
FIG. 3 is a micrograph of the new carrier layer.

In FIGS. 2 and 3 micrographs of the carrier layer 2 of valve seat ring 1 are shown. FIG. 2 depicts the microstructure of a conventional carrier layer 2 according to prior art while FIG. 3 illustrates within the scope of the present invention a micrograph taken of the carrier layer 2 of a valve seat ring 1. As can be clearly seen, the micrograph of carrier layer 2 in FIG. 3 shows a significantly higher copper content. In FIGS. 2 and 3 the bright spots/spaces represent the copper constituents whereas the dark spots show the share of the iron respectively iron-copper constituents.

Figure 4:
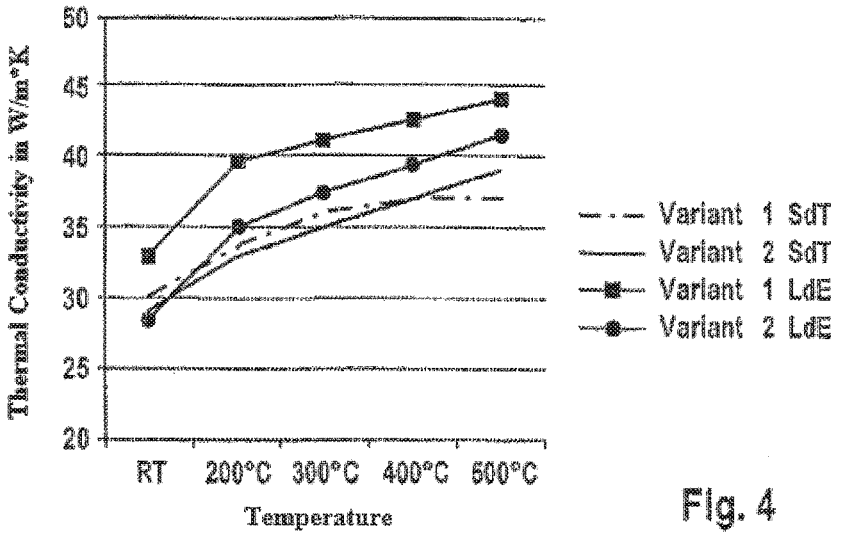
FIG. 4 is a diagram of the thermal conductivity of the entire valve seat ring according to prior art and according to the teaching of the invention.
Figure 5:
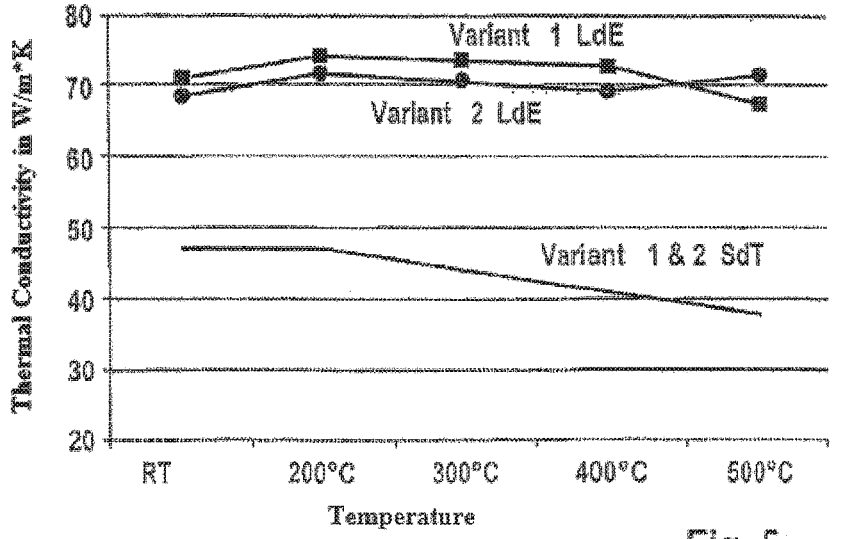
FIG. 5 is a diagram of the thermal conductivity of the carrier layer according to prior art and according to the teaching of the invention.

Diagrams illustrating the thermal conductivity of the valve seat rings 1, respectively the carrier layer 2 are shown in FIGS. 4 and 5. In the diagrams, the old method of manufacturing valve seat rings 1 (acc. to prior-art; SdT) are compared with the new manufacturing method (teaching of the invention; LdE). The thermal conductivity was measured at RWTH Aachen making use of the laser flash method.

FIG. 4 shows a diagram of the thermal conductivity of finished valve seat rings 1. The composition of the function layer 3 in variant 1 differs from the composition of variant 2. Function layer 3 according to prior art is assumed to be known. Regarding the composition of the carrier layer a distinction is made according to prior art and according to the teaching of the invention; It is clearly evident that the thermal conductivity of variants 1 and 2 according to the teaching of the invention considerably exceeds the thermal conductivity of variants 1 and 2 reflecting prior art.

FIG. 5 shows a diagram of the thermal conductivity of carrier layers 2 for two different variants of function layers 3 of valve seat rings 1. It can be seen that beginning with 48 W/m*K the thermal conductivity of the customary prior-art carrier layer 2 decreases as the temperature rises. In contrast, the thermal conductivity of carrier layer 2 for both variants according to the teaching of the into is on average slightly above 70 W/m*K. At a temperature of 500° C. the thermal conductivity of variants 1 & 2 according to the teaching of the invention (appr. 70 W/m*K) is 46% w/w higher than the thermal conductivity of variants 1 & 2 according to prior art (appr. 38 W/m*K).

The invention is explained in more detail by way of the following example:

EXAMPLE

The carrier layer consisting of a carrier material is press formed at 550 MPa to obtain a semi-finished product. The carrier material in this case consists of a combination of copper powder and an iron-copper alloy powder. The carrier layer has the form of a ring, with said ring having a great inwardly sloping inclination. Said semi-finished product is subsequently covered with a function material of powdery consistency and then press formed into a green compact thus producing the function layer. This green compact is sintered at 1100° C., with copper in wire form being added. Said added copper melts and penetrates by capillary action into the green compact during the sintering process. The alloy composition of the carrier layer of the finished valve seat ring is 1.2% w/w C, 0.3% w/w Mn, 0.2% w/w S, and 35% w/w Cu, with the alloy composition of the function layer amounting to 1.1% w/w C, 9.7% w/w Co, 1.4% w/w Mo, 2.5% w/w Ni, 3.0% w/w Cr, 0.5% w/w Mn, 0.5% w/w S, and 19.0% w/w Cu, in which the copper contents of the iron-copper alloy, the copper powder, and copper infiltration have been summarized.

The manufactured valve seat ring features high strength, good thermal conductivity, and lubricity.

The invention claimed is:

1. Powdermetallurgically produced valve seat ring comprising a carrier layer and a function layer, wherein the carrier material of the carrier layer has a total copper content ranging between >25 and 40% w/w to provide a thermal conductivity in excess of 55 W/m*K, characterized in that the carrier material contains an iron-copper alloy, the copper content of the iron-copper alloy exceeding 5% w/w, the materials of the carrier and the function layers containing copper added by infiltration.

2. Powdermetallurgically produced valve seat ring according to claim 1, characterized in that the carrier material of the carrier layer (2) has a thermal conductivity in excess of 65 W/m*K.

3. Powdermetallurgically produced valve seat ring according to claim 2, characterized in that the copper contents of the iron-copper alloy amounts to 10% w/w.

4. Powdermetallurgically produced valve seat ring according to any one of claim 2 or 3, characterized in that the carrier material contains a mixture of the iron-copper alloy and copper powder.

5. Powdermetallurgically produced valve seat ring according to claim 4, characterized in that the share of the copper powder ranges between 5 and 15% w/w.

6. Powdermetallurgically produced valve seat ring according to claim 1, characterized in that the carrier material and the function material contains copper added by means of infiltration.

7. Powdermetallurgically produced valve seat ring according to claim 6, characterized by a total copper content higher than 25% w/w.

8. Powdermetallurgically produced valve seat ring according to claim 1, provided with a carrier material forming the carrier layer (2) of

| | |
|---|---|
| 0.5 to 1.5% w/w | C |
| 0.1 to 0.5% w/w | Mn |
| 0.1 to 0.5% w/w | S |
| >25 to 40% w/w | Cu |
| Balance | Fe. |

9. Powdermetallurgically produced valve seat ring according to claim 1, provided with a function material forming the function layer (3) of

| | |
|---|---|
| 0.5 to 1.2% w/w | C |
| 6.0 to 12.0% w/w | Co |
| 1.0 to 3.5% w/w | Mo |
| 0.5 to 3.0% w/w | Ni |
| 1.5 to 5.0% w/w | Cr |
| 0.1 to 1.0% w/w | Mn |
| 0.1 to 1.0% w/w | S |
| 8.0 to 22.0% w/w | Cu |
| Balance % w/w | Fe. |

10. Powdermetallurgically produced valve seat ring according to any one of claim 1, provided with a function material forming the function layer (3) of

| | |
|---|---|
| 0.5 to 1.5% w/w | C |
| 5.0 to 12.0% w/w | Mo |
| 1.5 to 4.5% w/w | W |
| 0.2 to 2.0% w/w | V |
| 2.2 to 2.8% w/w | Cr |
| 0.1 to 1.0% w/w | Mn |
| 0.1 to 0.5% w/w | S |

-continued

| | |
|---|---|
| 12.0 to 24.0% w/w | Cu |
| Balance % w/w | Fe. |

11. Method for the manufacture of a valve seat ring by powder metallurgical techniques comprising a carrier layer (2) consisting of a carrier material as well as a function layer (3) of a function material, according to claim 1, wherein the following steps are taken Manufacturing a carrier layer (2) using a carrier material consisting of an iron copper alloy powder, where necessary, press forming the powder of the carrier layer (2) into a semi-finished product, manufacturing a function layer using a customary powdery function material, press forming the powder into a green compact, sintering the green compact in contact with copper.

12. Method according to claim 11, characterized in that the share of the iron-copper alloy powder in the carrier layer amounts to between 5% w/w and 15% w/w.

13. Method according to claim 12, characterized in that the iron-copper alloy powder is combined with graphite, wherein the share of the graphite in the carrier layer amounts to between 0.5% w/w and 1.5% w/w.

14. Method according to claim 11, characterized in that the carrier layer (2) is compressed to form a semi-finished component having a density of between 6.5 and 7.5 g/cm$^3$ by applying a pressing force of 450 to 700 MPa.

15. Method according to claim 11, characterized in that the green compact is multi-layered and densified.

16. Method according to claim 11, characterized in that the function layer contains copper is added by infiltration as a ring.

* * * * *